US008474737B2

(12) United States Patent
Evans et al.

(10) Patent No.: US 8,474,737 B2
(45) Date of Patent: Jul. 2, 2013

(54) ROTARY FORMING APPARATUS

(75) Inventors: Michael E. Evans, Granville, OH (US); John Hasselbach, Granville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 371 days.

(21) Appl. No.: 12/889,453

(22) Filed: Sep. 24, 2010

(65) Prior Publication Data

US 2012/0074249 A1 Mar. 29, 2012

(51) Int. Cl.
*B02C 18/22* (2006.01)

(52) U.S. Cl.
USPC ..... 241/62; 241/65; 241/243; 241/605

(58) Field of Classification Search
USPC ..... 241/3, 605, 62, 65, 243
See application file for complete search history.

(56) References Cited

U.S. PATENT DOCUMENTS

| | | | | |
|---|---|---|---|---|
| 2,327,087 | A * | 8/1943 | Austin | 264/141 |
| 4,228,964 | A | 10/1980 | Brady | |
| 4,381,082 | A * | 4/1983 | Elliott et al. | 241/186.5 |
| 4,682,523 | A | 7/1987 | Johnson et al. | |
| 5,637,326 | A | 6/1997 | Bogue et al. | |
| 5,683,810 | A | 11/1997 | Babbitt et al. | |
| 5,862,998 | A | 1/1999 | Bogue et al. | |
| 6,364,579 | B1 | 4/2002 | Gerber | |
| 7,264,422 | B2 | 9/2007 | Hasselbach et al. | |
| 8,162,243 | B2 * | 4/2012 | Wenthe et al. | 241/30 |
| 2007/0292547 | A1 | 12/2007 | Christensen | |
| 2008/0011020 | A1 | 1/2008 | Hasselbach et al. | |

* cited by examiner

*Primary Examiner* — Mark Rosenbaum
(74) *Attorney, Agent, or Firm* — Fraser Clemens Martin & Miller LLC; Charles F. Charple

(57) ABSTRACT

A rotary forming apparatus is provided. The rotary forming apparatus includes a separator configured to receive a gas flow having entrained fibrous material and further configured to separate the fibrous material from the gas flow. The fibrous material forms mini-blankets having a length along a longitudinal axis. A milling apparatus is positioned adjacent the separator and configured to receive mini-blankets exiting the separator. The milling apparatus is further configured to grind the mini-blankets into fibers having desired lengths. The milling apparatus is configured to grind the mini-blankets along the lengths of the mini-blankets.

20 Claims, 5 Drawing Sheets

ROTARY FORMING APPARATUS

BACKGROUND

During the process of manufacturing mineral fiber insulation, molten mineral material is generated in a melter or furnace and subsequently introduced into a plurality of fiberizers by way of a forehearth having a series of bushings. The fiberizers centrifuge the molten material and cause the material to be formed into fibers that are directed as a stream or veil to various collection units. The veils from typical fiberizing processes include large volumes of air and hot gases and entrained mineral fibers.

In some instances, the formed mineral fibers are collected on a collection device and formed into blankets or mats. The blankets or mats can be subsequently cut or chopped into tufts, flakes or other particulate insulation bodies. In other instances, the formed mineral fibers can be collected, chopped or bagged without being formed into blankets or mats. In these instances, the formed mineral fibers are separated from the large volumes of air and hot gases prior to subsequent downstream operations.

It would be advantageous to improve the systems that process the formed mineral fibers.

SUMMARY OF THE INVENTION

The above objects as well as other objects not specifically enumerated are achieved by a rotary forming apparatus. The rotary forming apparatus includes a separator configured to receive a gas flow having entrained fibrous material and further configured to separate the fibrous material from the gas flow. The fibrous material forms mini-blankets having a length along a longitudinal axis. A milling apparatus is positioned adjacent the separator and configured to receive mini-blankets exiting the separator. The milling apparatus is further configured to grind the mini-blankets into fibers having desired lengths. The milling apparatus is configured to grind the mini-blankets along the lengths of the mini-blankets.

According to this invention there is also provided a rotary forming apparatus. The rotary forming apparatus includes a separator configured to receive a gas flow having entrained fibrous material. The separator is further configured to separate the fibrous material from the gas flow. The fibrous material forms mini-blankets. The mini-blankets have a longitudinal axis. A milling apparatus is positioned adjacent the separator and configured to receive mini-blankets exiting the separator. The milling apparatus is further configured to grind the mini-blankets into fibers having a desired length. The milling apparatus includes a plurality of cutters configured for rotation about an axis. As the milling apparatus grinds the mini-blankets, the mini-blankets and the milling apparatus are arranged such that the longitudinal axis of the mini-blankets and the rotational axis of the plurality of cutters are substantially parallel.

According to this invention there is also provided a method for forming fibers having a predetermined length from a flow of gases and entrained fibrous material. The method includes the steps of intercepting the flow of gases and fibrous material with a separator, separating the fibrous material from the flow of gases, and depositing the fibrous material on an outer circumferential wall of the separator thereby forming mini-blankets, the mini-blankets having a length along a longitudinal axis, discharging the mini-blankets from the separator, intercepting the mini-blankets with rotating cutters in a milling apparatus, the milling apparatus positioned adjacent the separator and grinding the mini-blankets with the rotating cutters into fibers having desired lengths. The rotating cutters of the milling apparatus configured to grind away a longitudinal portion of the mini-blankets.

Various objects and advantages of the rotary forming apparatus will become apparent to those skilled in the art from the following detailed description of the preferred embodiment, when read in light of the accompanying drawings.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

The description and figures disclose rotary forming apparatus for formed mineral fibers. Generally, the rotary forming apparatus is configured to separate the formed mineral fibers from large volumes of hot air and gases and subsequently mill the separated mineral fibers into segments having desired lengths.

Figure 1:
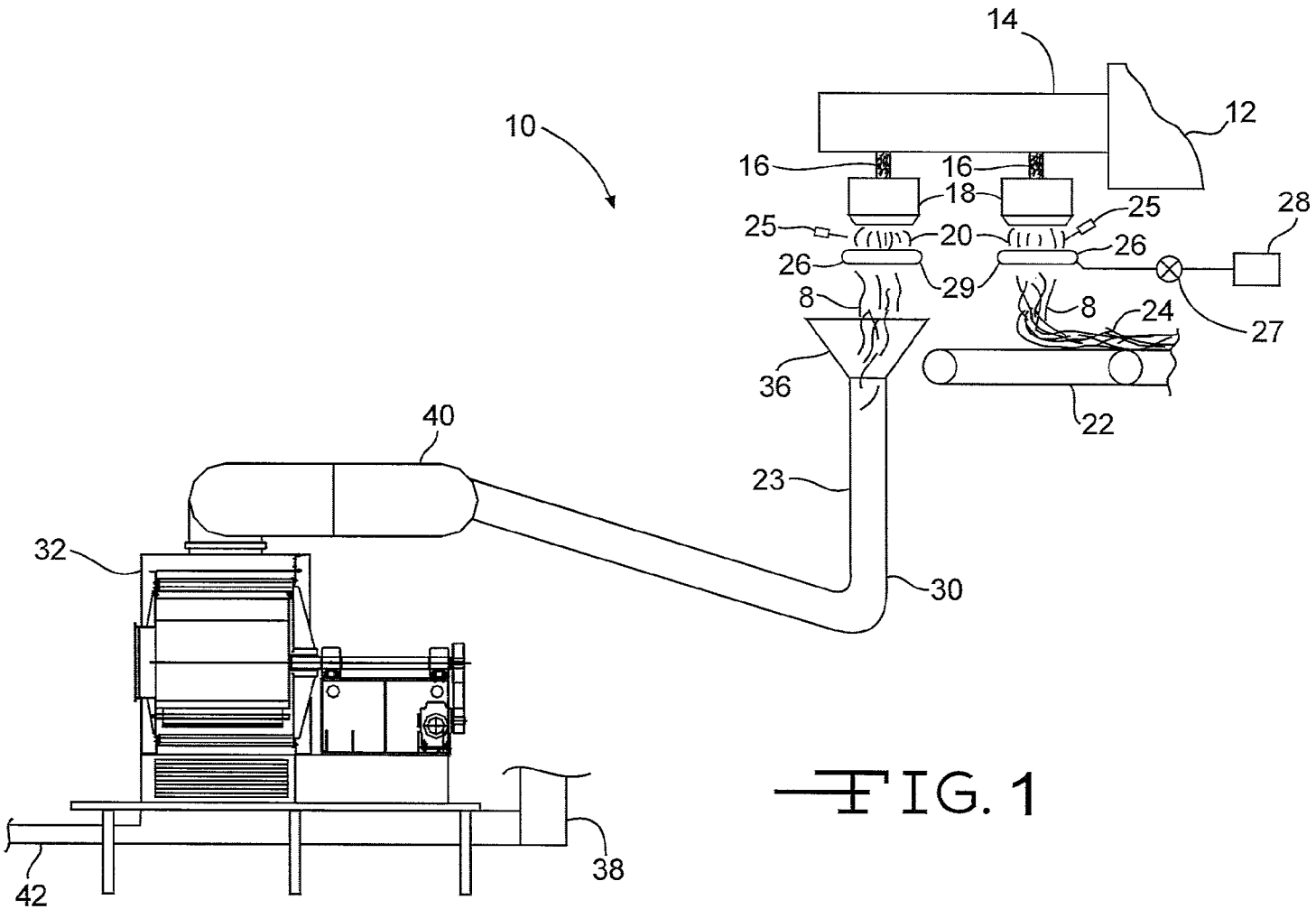
FIG. 1 is a schematic representation in elevation of a process for manufacturing fibers having desired lengths.

Referring now to FIG. 1, one example of a process for manufacturing mineral fibers is shown generally at 10. For purposes of clarity, the manufacturing process 10 will be described in terms of glass fiber manufacturing, but the manufacturing process 10 is applicable as well to the manufacture of fibrous products of other mineral materials, such as the non-limiting examples of rock, slag and basalt.

Referring again to FIG. 1, molten glass 16 is supplied from a forehearth 14 of a furnace 12 to rotary fiberizers 18 to form veils 20 of glass fibers 8 and hot gases. The flow of hot gases can be created by optional blowing mechanisms, such as the non-limiting examples of an annular blower (not shown) or an annular burner (not shown), to direct the glass fibers 8 in a given direction, usually in a downward manner.

The veils 20 are gathered and transported to downstream processing stations. While the embodiment illustrated in FIG. 1 shows a quantity of two fiberizers 18, it should be appreciated that any desired number of fiberizers 18 can be used. In one embodiment, the glass fibers 8 are gathered on a conveyor 22 such as to form a blanket 24. The blanket 24 is transported by the conveyor 22 to further processing stations (not shown). In other embodiments, the glass fibers 8 and hot gases are gathered by a gathering member 23. The gathering member 23 will be discussed in more detail below.

Referring again to FIG. 1, spraying mechanisms 25 are configured to spray fine droplets of water onto the hot gases in the veils 20 to help cool the flow of hot gases. The spraying mechanisms 25 can be any desired structure, mechanism or device sufficient to spray fine droplets of water onto the hot gases in the veils 20 to help cool the flow of hot gases.

Optionally, the glass fibers 8 can be coated with a lubricant after the glass fibers are formed. In the illustrated embodiment, a series of nozzles 26 are positioned in a ring 29 around the veil 20 at a position below the fiberizers 18. The nozzles 26 are configured to supply a lubricant (not shown) to the glass fibers 8 from a source 28. The lubricant is configured to prevent damage to the glass fibers 8 as the glass fibers 8 move through the manufacturing process 10 and come into contact with various apparatus components as well as other glass fibers 8. The lubricant can also be useful to reduce dust in the ultimate product. The application of the lubricant is controlled by a valve 27 such that the amount of lubricant being applied can be precisely controlled. In the embodiment illustrated in FIG. 1, the lubricant is a silicone compound. However, the lubricant can also be other materials or combinations of materials, such as for example an oil emulsion. In the illustrated embodiment, the lubricant is applied in an amount of about 1.0 percent oil by weight. However, in other embodiments, the amount of the lubricant can be more or less than about 1.0 percent oil by weight.

It should be noted that since this portion of the manufacturing process 10 is being used to form loosefill insulation, a binder material is not applied to the glass fibers 8 in order to make a binderless product. The term "binderless", as used herein, is defined to mean any binder material applied to the glass fibers in an amount less than or equal to approximately one percent by weight of the product. However, it should be appreciated that in other embodiments any amount of binder could be applied to the fibers 8 as desired depending on the specific application and design requirements.

As discussed above, the glass fibers 8 and hot gases can be collected by the gathering member 23. The gathering member 23 is shaped and sized to easily receive the glass fibers 8 and hot gases. The gathering member 23 is configured to divert the glass fibers 8 and hot gases to a duct 30 for transfer to one or more processing stations for further handling. The gathering member 23 and the duct 30 can be any generally hollow pipe members that are suitable for receiving and conveying the glass fibers 8 and hot gases. In the embodiment shown in FIG. 1, a fiberizer 18 is associated with an individual gathering member 23 such that the glass fibers 8 and hot gases are received directly into the gathering member 23. Alternatively, a single gathering member 23 can be adapted to receive the glass fibers 8 and hot gases from multiple fiberizers 18 (not shown). Although the manufacturing process 10 is shown with a gathering member 23, it is to be understood that the gathering member 23 is optional, and the glass fibers 8 and hot gases can be directed from the fiberizers 18 to other downstream operations (not shown).

Referring again to FIG. 1, the glass fibers 8 created by the fiberizer 18 are intercepted by the gathering member 23 at a point beneath the fiberizer 18, the spraying mechanisms 25 and the lubricant nozzles 26. An entrance section 36 is positioned at an upper end of the gathering member 23. The entrance section 36 is configured to facilitate collection of the glass fibers 8 and hot gases in the veil 20. In the illustrated embodiment, the entrance section 36 has a funnel-shape or a frusto-conical shape. In other embodiments, the entrance section 36 can have other shapes sufficient to efficiently collect the glass fibers 8 and hot gases in the veil 20.

Referring again to the embodiment illustrated in FIG. 1, the duct 30 is configured to have a minimal number of directional changes such that the flow of glass fibers 8 and hot gases can be more efficiently transferred from the fiberizer 18 to the rotary forming apparatus 32.

In the illustrated embodiment, the momentum of the flow of the hot gases will cause the glass fibers 8 to continue to flow through the gathering member 23 and the duct 30 to a rotary forming apparatus 32, where the entrained glass fibers 8 are separated from the hot gases. Alternatively, or additionally, there can be other mechanisms or devices (not shown) configured to draw or push the glass fibers 8 towards the rotary forming apparatus 32.

As shown in FIG. 1 a header system 40 is positioned between the rotary forming apparatus 32 and the fiberizer 18. The header system 40 is configured as a chamber in which glass fibers 8 and hot gases flowing from the plurality of fiberizers 18 can be combined while controlling the characteristics of the resulting combined flow. In certain embodiments, the header system 40 can include a control system (not shown) configured to combine the flows of the glass fibers 8 and hot gases from various fiberizers 18 and further configured to direct the resulting combined flows to various rotary forming apparatus 32. Such a header system 40 can allow for maintenance and cleaning of certain fiberizers 18 without the necessity of shutting down the remaining fiberizers 18 while one fiberizer 18 is not operating. Optionally, the header system 40 can incorporate any desired means for controlling and directing the glass fibers 8 and flows of hot gases.

Referring again to FIG. 1, an air flow exhaust duct 38 is connected to the rotary forming apparatus 32. The air flow exhaust duct 38 is configured to exhaust hot gases separated from the glass fibers 8 in the rotary forming apparatus 32. In the illustrated embodiment, the exhaust duct 38 includes an optional fan (not shown) configured to draw the glass fibers 8 towards the rotary forming apparatus 32.

From the rotary forming device 32, the separated fibers are transported to other downstream operations, such as for example, bagging operations, via a transfer duct 42. As with the duct (30) described above, the transfer duct 42 can be a generally hollow pipe or other conduit suitable for handling the separated glass fibers 8.

Figure 2:
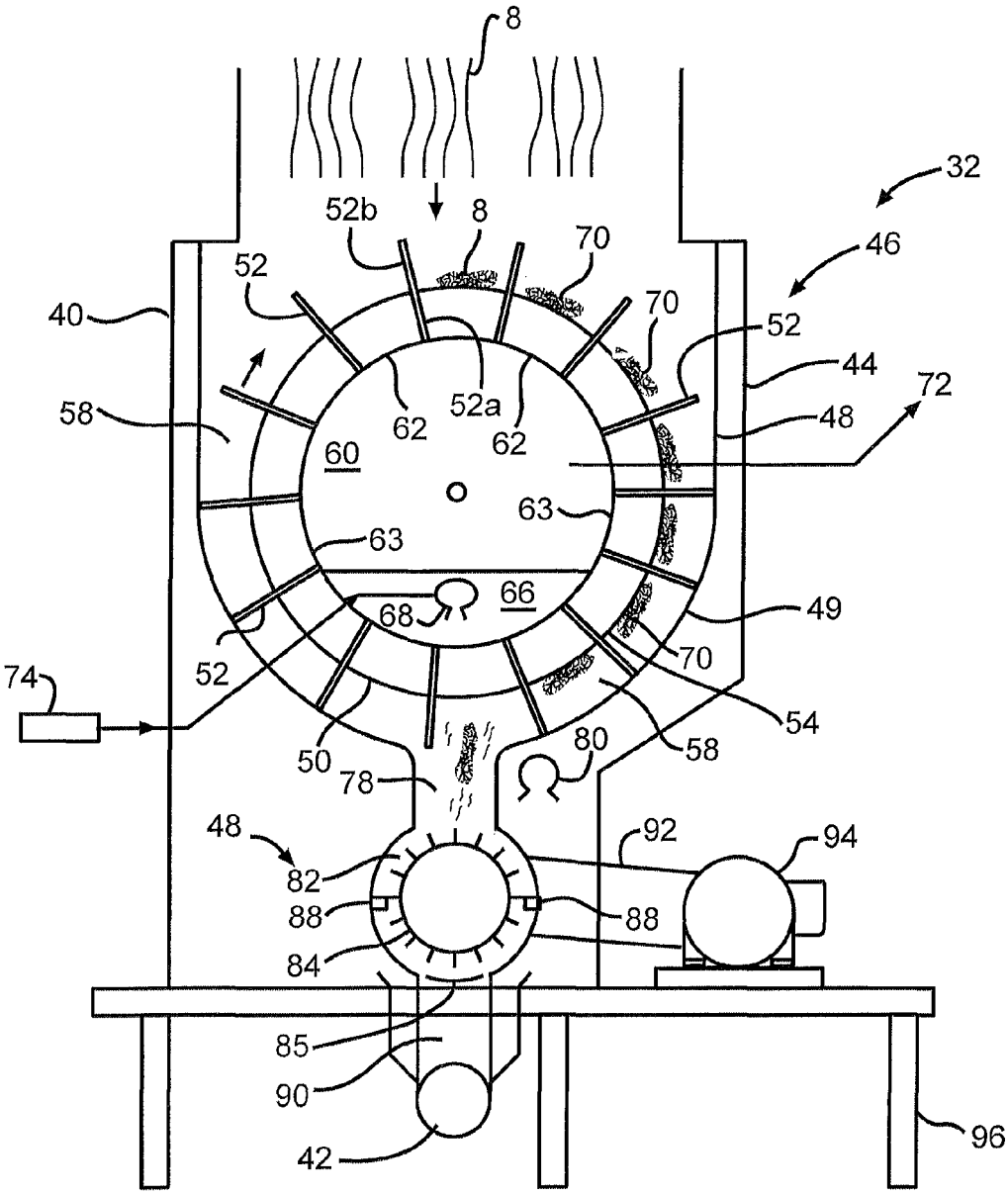
FIG. 2 is a side view, in elevation, of a rotary forming apparatus for the manufacturing process of FIG. 1.

Referring now to FIG. 2, the rotary forming apparatus 32 is shown in more detail. The rotary forming apparatus 32 includes a stationary outer housing 44 and end walls (not shown). As will be described in more detail below, the outer housing 44 houses a separator 46 and a milling apparatus 48.

Referring again to FIG. 2, the separator 46 includes an inner housing 49 and a rotatable drum 50 positioned within the inner housing 49. The rotatable drum 50 is a generally cylindrical component that can be rotatably driven by any suitable means, such as for example an electric motor (not shown). The rotatable drum 50 includes an outer circumferential wall 54 configured as a foraminous or perforated surface. The perforations (not shown) of the perforated surface are sized to allow the gases to flow through the perforations but prevent the glass fibers 8 from passing through the perforations.

Positioned within the rotating drum 50 is a stationary plenum or inner chamber 60. The inner chamber 60 is connected to the air flow exhaust duct (not shown) and configured to exhaust or vent hot gases from within the inner chamber 60. The exhausting or venting of the hot gases from the inner chamber 60 to the air flow exhaust duct is indicated schematically in FIG. 2 by the arrow 72. The exhausting or venting of the inner chamber 60 creates a zone of reduced pressure within the inner chamber 60. The term "reduced pressure", as used herein, is defined to mean a pressure that is less than that of the outside atmosphere. It is to be understood that any mechanism suitable for creating reduced pressure within the inner chamber can be used. Non-limiting examples of such a mechanism include a fan or blower. The inner chamber 60 is porous over an upper portion 62 of its wall so that air and other gases can flow through the perforated circumferential wall 54 and be drawn into the zone of reduced pressure established in the inner chamber 60. Lower portions 63 of the inner chamber wall are not perforated and are impervious to air flow.

Referring again to FIG. 2, the drum 50 has a plurality of vanes 52 extending through and spaced about its outer circumferential wall 54. The vanes 52 are carried with the drum 50 as the drum 50 rotates. In the illustrated embodiment, the vanes 52 extend in a direction that is substantially perpendicular to the outer circumferential wall 54 and contact the inner housing 49. However, the vanes 52 can have other orientations suitable to extend from the outer circumferential wall 54 and contact the inner housing 49. The term "orientation", as used herein, is defined to mean any angle with respect to the circumferential wall 54.

A compartment 58 is defined as the space bounded by any two adjacent vanes 52, the outer circumferential wall 54, and the inner housing 49. The compartments 58 are configured to receive glass fibers 8 that are collected on the outer circumferential wall 54. The glass fibers 8 collected within a compartment 58 are initially loosely held together by the reduced pressure from the inner chamber 60. The accumulation of the glass fibers 8 within a compartment forms a mini-blanket 70 of the glass fibers 8.

Referring again to FIG. 2, the vanes 52 include an inner vane portion 52*a* and an outer vane portion 52*b*. The outer vane portion 52*b* is the vane portion that defines one of the boundaries of the compartments 58. The outer vane portion 52*b* also forms a seal with the inner housing 49. The inner vane portion 52*a* separates the inner chamber 60 from the outer circumferential wall 54 of the drum 50. The inner vane portion 52*a* also separates the inner chamber 60 from the compartments 58. Accordingly, the inner vane portion 52*a* is configured to form an inner seal between the inner chamber 60 and the compartments 58, thereby providing a barrier to peripheral flow around the drum 50. In the illustrated embodiment, the inner vane portions 52*a* are collinear with the outer vane portions 52*b*. However, in other embodiments the inner and outer vane portions 52*a* and 52*b* can have other relative positions, such as for example staggered.

As shown in FIG. 2, the vanes 52 are positioned such that several of the outer vane portions 52*b* are in contact with the inner housing 49 at all times such as to facilitate the creation of the zone of reduced pressure within the inner chamber 60. The spacing of the vanes 52 about the circumference of the drum 50 is such that as the drum 50 rotates one vane 52 out of contact with the outer casing 48, another vane 52 comes into contact with the outer casing 48. In this manner, air leakage or short circuiting of air into the inner chamber 60 around the vanes 52, between the drum 50 and the outer casing 48, is substantially minimized. While the embodiment illustrated in FIG. 2 provides vanes configured to facilitate the creation of the zone of reduced pressure within the inner chamber 60, it should be understood that the vanes 52 are optional, and other structures, mechanisms and devices can be used to maintain the zone of reduced pressure within the inner chamber 60. In certain embodiments, the vanes 52 can be formed from or coated with a somewhat flexible high temperature resistant material so as to provide a relatively tight seal with the inner housing 49. One non-limiting example of a flexible high temperature resistant material is TEFLON® material, commercially available from the DuPont Corporation of Wilmington, Del.

Referring again to FIG. 2, positioned within the rotating drum 50 is a lower chamber 66. The lower chamber 66 forms a zone of increased pressure within the rotating drum 50. The term "increased pressure", as used herein, is defined to mean a pressure that is greater than or equal to that of the outside atmosphere. When a compartment 58 of the drum 50 has rotated to a position where the compartment 58 is no longer influenced by the reduced pressure of the inner chamber 60, the glass fibers 8 forming the mini-blanket 70 are influenced by the increased pressure of the lower chamber 66. Influencing the glass fibers 8 forming the mini-blankets 70 with increased pressure results in the discharge of the mini-blankets 70 from the compartments 58.

In the illustrated embodiment, the zone of increased pressure within the lower chamber 66 is created by a blow off header 68. The blow off header 68 is connected with a source of air pressure 74. The blow off header 68 and the source of air pressure 74 can be any structure, mechanism or device, or combinations thereof, sufficient to create a zone of increased pressure within the lower chamber 66.

The mini-blankets 70 exit the compartments 58 through a transfer duct 78 and enter the milling apparatus 48. Optionally, additional blow off headers 80 can be positioned adjacent the transfer duct 78 and configured to blow the mini-blankets 70 through the transfer duct and into the milling apparatus 48. The optional blow off headers 80 can be positioned in an orientation so that they further clean the surface of the drum 50. In certain embodiments, the optional blow off headers can be used on an intermittent basis, such as the non-limiting example of once every twenty-four hours, to blow air onto the outer circumferential wall 54 of the drum 50 to remove any excess fibers, dust, or other materials that can diminish the effectiveness of the separator 46.

While the embodiment illustrated in FIG. 2 shows the glass fibers 8 in the form of a mini-blanket 70 exiting the compartments 58, it should be understood that the glass fibers 8 exiting the compartments 58 can have various forms, including randomly oriented fibrous material not formed into mini-blankets 70 or combinations of mini-blankets 70 and randomly oriented fibrous material.

Referring again to FIG. 2, the milling apparatus 48 is configured to grind or cut the mini-blankets 70 into fibers having desired lengths. After grinding or cutting by the milling apparatus 48, the ground fibers exit the milling apparatus 48 and are transported to other downstream operations, such as for example, bagging operations, via the transfer duct 42.

While the embodiment illustrated in FIG. 2 shows the milling apparatus 48 as positioned beneath the separator 46, it should be appreciated that other embodiments of the rotary forming apparatus 32 can have the milling apparatus 48 in other orientations relative to the separator 46, such as for example horizontally adjacent the separator 46.

The milling apparatus 48 includes a generally cylindrically shaped housing 82 and a rotor assembly 84 positioned within the housing 82. The rotor assembly 84 is configured for rotation. The rotor assembly 84 includes a plurality of cutters 86 positioned circumferentially around the rotor assembly 84. A plurality of stationary knives 88 is positioned within the housing 82 and configured to cooperate with the plurality of cutters 86 such as to grind or cut the glass fibers 8 forming the mini-blankets 70 into desired lengths. The rotor assembly 84, cutters 86 and stationary knives 88 can have any desired structure sufficient to grind or cut the glass fibers 8 forming the mini-blankets 70 into desired lengths.

A discharge screen 85 is positioned beneath the rotor assembly 84 and configured to allow ground glass fibers to exit the housing 82 through an exit duct 90 and enter the transfer duct 42. The discharge screen 85 can have any desired size and shape perforations.

In the embodiment illustrated in FIG. 2, the rotor assembly 84 is rotated by a dedicated belt 92 and electric motor 94 arrangement. In other embodiments, the rotor assembly 84 can be rotated by other desired power sources.

While the embodiment illustrated in FIG. 2 shows the milling apparatus 48 being formed as an integral assembly within the rotary forming apparatus 32, it is within the contemplation of this invention that the milling apparatus is a commercially available assembly which is subsequently incorporated into the rotary forming apparatus 32. One non-limiting example of a commercially available milling apparatus is the Munson Model SCC72, marketed by Munson Machinery Company, Inc., headquartered in Utica, N.Y.

As shown in FIG. 2, the rotary forming apparatus 32 and the electric motor 94 can be mounted on a framework 96. The framework 96 can be any desired structure or combination of structures.

Figure 3:
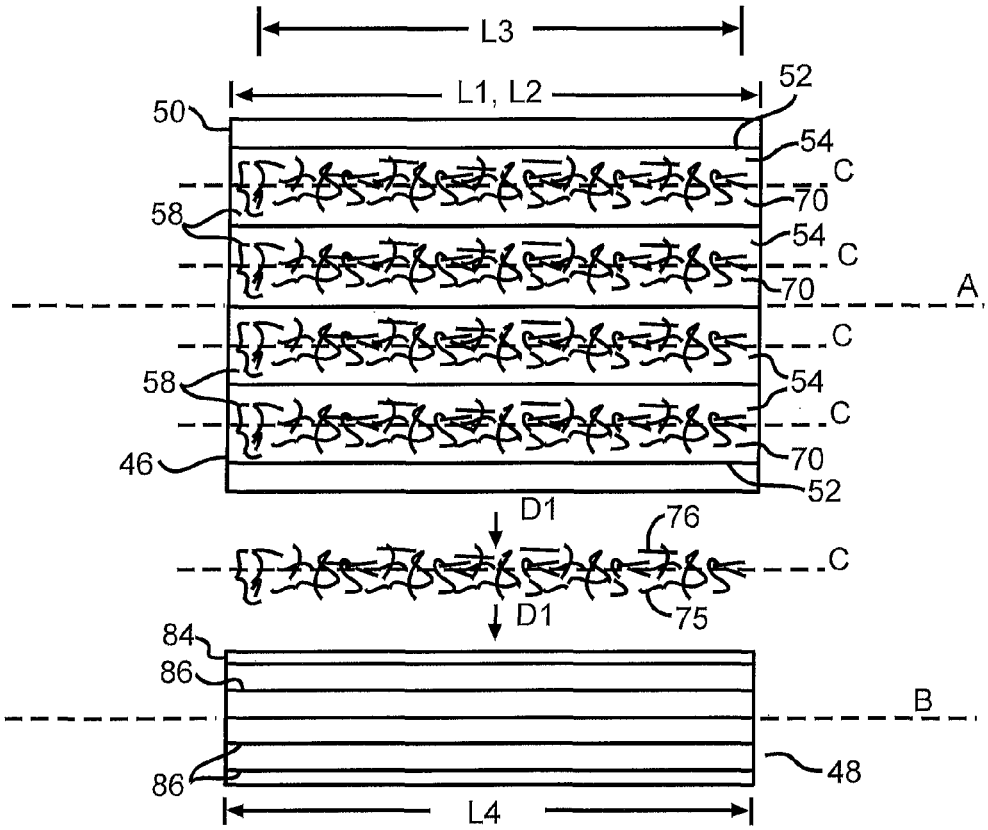
FIG. 3 is a side view, in elevation, of a rotating drum and a milling apparatus of the rotary forming apparatus of FIG. 2.

Referring now to FIG. 3, portions of the separator 46 and the milling apparatus 48 are illustrated. The separator 46 includes the rotatable drum 50 having the compartments 58 formed by the outer circumferential wall 54 and the vanes 52. The mini-blankets 70 are shown positioned in the compartments 58 as discussed above. The rotatable drum 50 rotates about axis A. The milling apparatus 48 includes rotor assembly 84 and the cutters 86. The rotor assembly 84 rotates about axis B. In the illustrated embodiment, axis A and axis B are positioned substantially in the same vertical plane and substantially parallel to each other. In other embodiments, axis A and axis B can be in different vertical planes and can be non-parallel.

Referring again to FIG. 3, the rotatable drum 50 has a length L1. In the illustrated embodiment, the length L1 is in a range of from about 24.0 inches to about 100.0 inches. In other embodiments, the length L1 can be less than about 24.0 inches or more than about 100.0 inches.

The compartments 58 have a length L2 that is generally equal to or slightly less than the length L1 of the rotatable drum 50. Accordingly, in the illustrated embodiment, the length L2 of the compartments is in a range of from about 24.0 inches to about 100.0 inches. In other embodiments, the length L2 can be less than about 24.0 inches or more than about 100.0 inches.

The mini-blankets 70 have a length L3 along a longitudinal axis C. The length L3 is generally equal to or slightly less than the length L2 of the compartments 58. Accordingly, in the illustrated embodiment, the length L3 of the mini-blankets 70 is in a range of from about 24.0 inches to about 100.0 inches. In other embodiments, the length L3 can be less than about 24.0 inches or more than about 100.0 inches.

The milling apparatus 48 has a length L4 that is generally equal to the length L1 of the rotatable drum 50. Accordingly, in the illustrated embodiment, the length L4 of the milling apparatus 48 is in a range of from about 24.0 inches to about 100.0 inches. In other embodiments, the length L4 can be less than about 24.0 inches or more than about 100.0 inches.

As shown in FIG. 3, the mini-blankets 70 are positioned in the compartments 58 of the separator 46 in a generally horizontal orientation. The term "horizontal orientation", as used herein, is defined to mean the longitudinal axis C of the mini-blankets 70 is substantially parallel to a horizontal line. In this orientation, the longitudinal axis C of the mini-blankets 70 is substantially parallel to the axis A of the separator and axis B of the milling apparatus 48

Figure 5A:
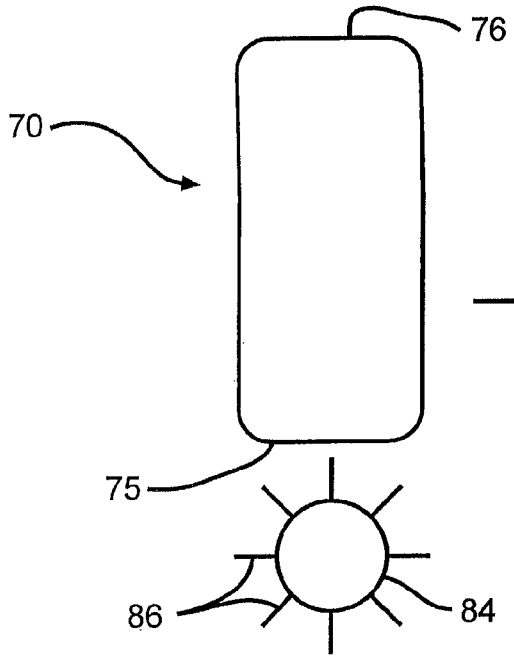
FIG. 5A is a cross-sectional view of the mini-blanket of FIG. 4A taken along the line 5A-5A.

Referring now to the embodiment illustrated in FIG. 5A, the mini-blanket 70 has a generally rectangular cross-sectional shape. Alternatively, the mini-blanket 70 can have other cross-sectional shapes.

Figure 4A:
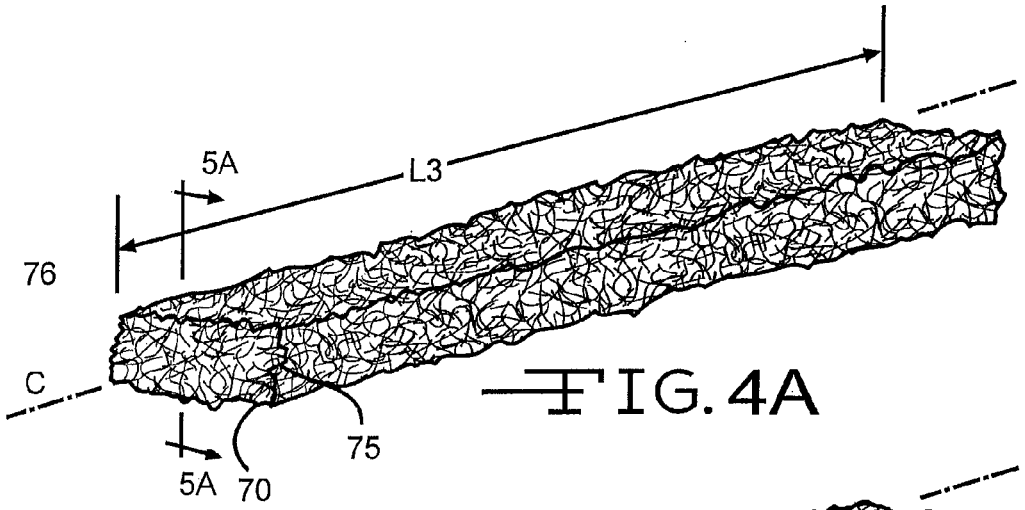
FIG. 4A is a prospective view of an uncut mini-blanket formed by the rotating drum of FIG. 3.

Referring again to FIG. 5A, the mini-blanket 70 has a leading face 75 and a trailing face 76. As shown in FIG. 4A, the leading face 75 has a length that is substantially parallel to the longitudinal axis C of the mini-blanket 70.

Referring again to FIG. 3, the mini-blankets 70 exit the separator 46 in a direction indicated by the arrows Dl. Upon exiting the separator 46, the longitudinal axis C of the mini-blanket 70 maintains the same substantially horizontal orientation as discussed above. In this position, the leading face 75 of the mini-blanket 70 is oriented in the direction of the milling apparatus 48 and the trailing face 76 is oriented in the direction of the separator 46. The mini-blankets 70 enter the milling apparatus 48 in the same orientation, that is, with the longitudinal axis C of the mini-blanket 70 in the substantially horizontal orientation and with the leading face 75 oriented in the direction of the milling apparatus 48 and the trailing face 76 oriented in the direction of the separator 46.

Referring again to FIG. 3, as the mini-blankets 70 enters the cutters 86 positioned on the rotor assembly 84, the cutters 86 initially engage the leading face 75 of the mini-blanket 70 along the length L3 of the mini-blanket 70.

Referring now to FIGS. 4A-4C and 5A-5C, the cutting of the mini-blanket 70 along the length L3 of the mini-blanket 70 is illustrated. Referring first to FIGS. 4A and 5A, the mini-blanket 70 is shown as it exits the separator 46 and enters the milling apparatus 48. As discussed above, the mini-blanket 70 includes the leading face 75, the trailing face 76 and the substantially horizontal longitudinal axis C.

Figure 4B:
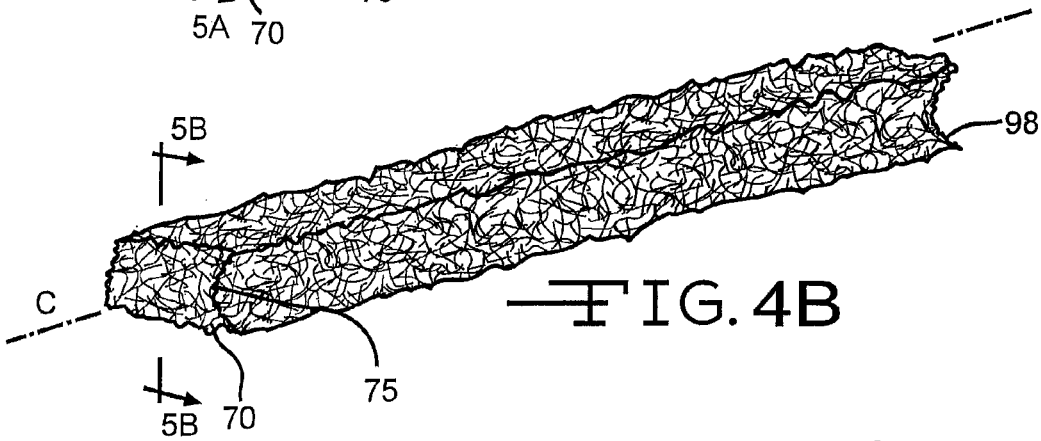
FIG. 4B is a prospective view of the mini-blanket of FIG. 4A after an initial cut has been taken along the length of the mini-blanket.
Figure 5B:
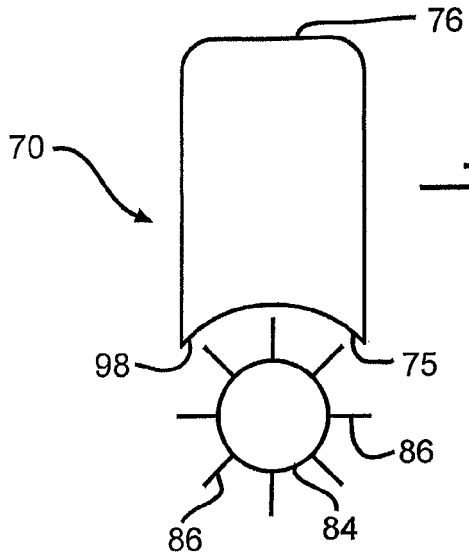
FIG. 5B is a cross-sectional view of the mini-blanket of FIG. 4B taken along the line 5B-5B.

Referring now to FIGS. 4B and 5B, the mini-blanket 70 is shown after an initial engagement with the cutters 86 positioned on the rotor assembly 84. As can be seen in FIG. 4*b*, the cutters 86 engage the leading face 75 of the mini-blanket 70 along the length L3 of the mini-blanket 70 and remove a first bite 98 from the mini-blanket 70. In this manner, the cutters 86 are configured to grind away longitudinal portions of the mini-blankets 70. The first bite 98 has a length that is parallel with the longitudinal axis C of the mini-blanket 70.

Figure 4C:
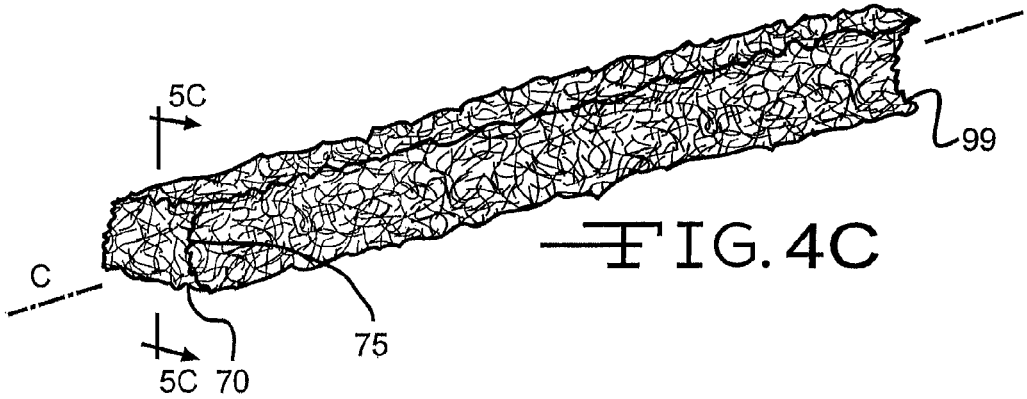
FIG. 4C is a prospective view of the mini-blanket of FIG. 4B after subsequent cuts have been taken along the length of the mini-blanket.
Figure 5C:
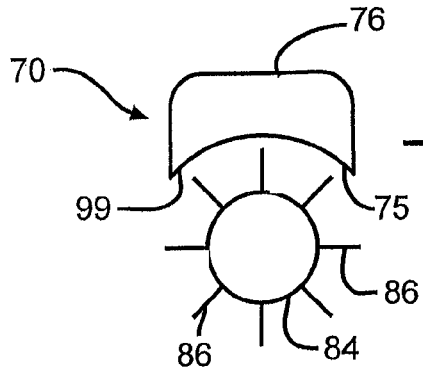
FIG. 5C is a cross-sectional view of the mini-blanket of FIG. 4C taken along the line 5C-5C.

Referring now to FIGS. 4C and 5C, the mini-blanket 70 is shown after subsequent engagements with the cutters 86 positioned on the rotor assembly 84. As can be seen in FIG. 4*c*, the cutters 86 engage the leading face 75 of the mini-blanket 70 along the length L3 of the mini-blanket 70 and remove subsequent bites 99 from the mini-blanket 70. The subsequent bites 99 are parallel with the longitudinal axis C of the mini-blanket 70. The cutters 86 continue to engage the leading face 75 of the mini-blanket 70 in a similar manner until the mini-blanket 70 has been completely consumed by the cutters 86.

Configuring the rotary forming apparatus 32 to incorporate the separator 46 and the milling apparatus 48 advantageously provides significant benefits, although all benefits may not be realized in all embodiments. First, manufacturing floor space is reduced. Second, noise generated by the separator 46 and the milling apparatus 48 can be consolidated into a single area. Third, as discussed above, positioning the milling apparatus 48 below the separator 46 allows the mini-blankets to be engage by the cutters 86 along the length L3 of the mini-blankets 70, thereby providing benefits to the milling apparatus 48 and to the resulting ground glass fibers. The cutters 86 within the milling apparatus 48 benefit by having a consistent cutting pattern, thereby resulting in an extended cutter 86 life. The consistent cutting pattern of the cutters 86 along the length of the mini-blankets 70 further provides in a more consistent grinding of the glass fibers 8, thereby resulting in less compaction of the glass fibers 8. Less compaction of the glass fibers 8 results in an improved thermal conductivity.

In accordance with the provisions of the patent statutes, the principle and mode of operation of the rotary forming apparatus have been explained and illustrated in its preferred embodiment. However, it must be understood that the rotary forming apparatus may be practiced otherwise than as specifically explained and illustrated without departing from its spirit or scope.

What is claimed is:

1. A rotary forming apparatus comprising:

a separator configured to receive a hot gas flow having entrained fibrous material, the separator further configured to separate the fibrous material from the hot gas flow, the separator having a plurality of compartments arranged circumferentially about a perforated outer wall of a rotatable drum, the outer wall being permeable to the hot gas flow, the separator also having an inner chamber, the inner chamber having an upper portion and a lower portion, the upper portion being porous and the lower portion being impervious to the hot gas flow, the upper portion of the inner chamber having a zone of reduced pressure and the lower chamber having a zone of increased pressure, the compartments configured to receive the hot gas flow and the entrained fibrous material such as to form mini-blankets, the mini-blankets having a length along a longitudinal axis; and a milling apparatus positioned adjacent the separator, the milling apparatus having a plurality of cutters positioned circumferentially about a rotor and a plurality of stationary knives positioned to cooperate with the cutters, each of the cutters having a length that approximates the length of the rotor, the milling apparatus configured to receive mini-blankets exiting the separator, the milling apparatus further configured to grind the mini-blankets into fibers having desired lengths;

wherein the milling apparatus is configured to grind the mini-blankets along the lengths of the mini-blankets.

2. The rotary forming apparatus of claim 1, wherein each of the compartments has a longitudinal axis that has a substantially horizontal orientation.

3. The rotary forming apparatus of claim 2, wherein a transfer duct is positioned between the separator and the milling apparatus, wherein the transfer duct is configured to maintain the substantially horizontal orientation of the mini-blankets between the separator and the milling apparatus.

4. The rotary forming apparatus of claim 3, wherein the milling apparatus has a housing, wherein the housing is configured to maintain the mini-blankets in a substantially horizontal orientation upon entering milling apparatus.

5. The rotary forming apparatus of claim 1, wherein the milling apparatus is positioned beneath the separator.

6. The rotary forming apparatus of claim 1, wherein the mini-blankets have a length in a range of from about 24.0 inches to about 100.0 inches.

7. The rotary forming apparatus of claim 1, wherein the separator is connected to a header system along with a plurality of other separators.

8. The rotary forming apparatus of claim 1, wherein the mini-blankets have a leading face that is substantially parallel to the longitudinal axis of the mini-blanket, wherein the milling apparatus initially engages the leading face of the mini-blanket and grinds the leading face of the mini-blankets along the length of the mini-blankets.

9. The rotary forming apparatus of claim 8, wherein subsequent engagements of the milling apparatus with the leading face of the mini-blanket are along the length of the mini-blanket.

10. The rotary forming apparatus of claim 1, wherein the separator and the milling apparatus are positioned within a common outer housing.

11. The rotary forming apparatus of claim 1, wherein the fiberous material forming the mini-blankets is binderless.

12. A rotary forming apparatus comprising:

a separator configured to receive a hot gas flow having entrained fibrous material, the separator further configured to separate the fibrous material from the hot gas flow, the separator having a plurality of compartments arranged circumferentially about a perforated outer wall of a rotatable drum, the outer wall being permeable to the hot gas flow, the separator also having an inner chamber, the inner chamber having an upper portion and a lower portion, the upper portion being porous and the lower portion being impervious to the hot gas flow, the upper portion of the inner chamber having a zone of reduced pressure and the lower chamber having a zone of increased pressure, the compartment configured to receive the hot gas flow and the entrained fibrous material such as to form mini-blankets, the mini-blankets having a longitudinal axis; and a milling apparatus positioned adjacent the separator, the milling apparatus having a plurality of cutters positioned circumferentially about a rotor and a plurality of stationary knives positioned to cooperate with the cutters, each of the cutters having a length that approximates the length of the rotor, the milling apparatus configured to receive mini-blankets exiting the separator, the milling apparatus further configured to grind the mini-blankets into fibers having a desired length;

wherein as the milling apparatus grinds the mini-blankets, the mini-blankets and the milling apparatus are arranged such that the longitudinal axis of the mini-blankets and the rotational axis of the plurality of cutters are substantially parallel.

13. The rotary forming apparatus of claim 12, wherein each of the compartments has a longitudinal axis that has a substantially horizontal orientation.

14. The rotary forming apparatus of claim 13, wherein a transfer duct is positioned between the separator and the milling apparatus, wherein the transfer duct is configured to maintain the substantially horizontal orientation of the mini-blankets between the separator and the milling apparatus.

15. The rotary forming apparatus of claim 14, wherein the milling apparatus has a housing, wherein the housing is configured to maintain the mini-blankets in a substantially horizontal orientation upon entering milling apparatus.

16. The rotary forming apparatus of claim 12, wherein the milling apparatus is positioned beneath the separator.

17. The rotary forming apparatus of claim 12, wherein the plurality of cutters has a length in a range of from about 24.0 inches to about 100.0 inches.

18. The rotary forming apparatus of claim 12, wherein the mini-blankets have a leading face that is substantially parallel to the longitudinal axis of the mini-blanket, wherein the cutters of the milling apparatus initially engage the leading face of the mini-blanket and grind the leading face of the mini-blankets along the length of the mini-blankets.

19. The rotary forming apparatus of claim 12, wherein the separator and the milling apparatus are positioned within a common outer housing.

20. The rotary forming apparatus of claim 12, wherein the fiberous material forming the mini-blankets is binderless.

* * * * *